US007287479B1

(12) United States Patent
Huang

(10) Patent No.: US 7,287,479 B1
(45) Date of Patent: Oct. 30, 2007

(54) SEMI-AUTOMATIC DEVICE FOR BALL STITCHING MACHINE

(76) Inventor: Yao-Jen Huang, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 11/503,054

(22) Filed: Aug. 14, 2006

(51) Int. Cl.
*D05B 39/00* (2006.01)
*D05B 35/00* (2006.01)

(52) U.S. Cl. ..... 112/470.35

(58) Field of Classification Search ..... 112/470.35, 112/152, 153, 311, 221, 475.08; 473/FOR. 136, 473/FOR. 157, FOR. 148, FOR. 152
See application file for complete search history.

(56) References Cited

U.S. PATENT DOCUMENTS 1,129,008 A * 2/1915 Perry ..... 112/470.35
1,167,265 A * 1/1916 Brusseau ..... 112/470.35
2,747,529 A * 5/1956 Haas ..... 112/470.35
2,976,827 A * 3/1961 Bauder, Jr. ..... 112/470.35
3,151,584 A * 10/1964 Fossa ..... 112/470.35
4,248,165 A * 2/1981 Addy et al. ..... 112/470.35
6,223,668 B1 * 5/2001 Chan ..... 112/475.08

* cited by examiner

*Primary Examiner*—Ismael Izaguirre

(57) ABSTRACT

A stitch tightening device of a ball stitching machine comprises a ball stitching table having at least one clamping tool and a stitch tightening unit for tightening a thread to be assembled to a ball. The stitch tightening unit includes a set of thread clamping units at two sides of the clamping tool. The stitch control device is interconnected with and interacted with a first treadle through a driven element; and the stitch tightening unit has at least two clampers; the first treadle drives a control wire; and then the control wire drives the clamper so as to engage the thread clamping unit. The clamping head is connected to a second treadle through a linkage; and the second treadle drives the clamping head to move aside to be away from the stitch control device. The first treadle drives a control wire through a driven element.

3 Claims, 6 Drawing Sheets

SEMI-AUTOMATIC DEVICE FOR BALL STITCHING MACHINE

FIELD OF THE INVENTION

The present invention relates to ball stitching machines, and in particular to a stitching thread tightening device of a ball stitching machine, in that the stitching thread control device tightly clamps the stitching thread for manufacturing the finished sporting ball so that the worker only needs to use minimum force to pull and set the stitches on balls. The operation of this device is convenient for workers and reduces the training time for said workers.

BACKGROUND OF THE INVENTION

Generally, the cores for sporting balls, such as baseballs or softballs, etc. have a solid center for absorbing the force while being hit with a bat during game use. Furthermore the ball must have sufficient elasticity. The center or core of the ball must be produced with a soft or solid material and a two piece cover material is stitched over the core.

Referring to FIG. 9 in stitching the ball, a core is placed with two pieces of cover panels 11 so as to form a half-finished sporting ball 1. The half-finished sporting ball is placed on a clamping tool 2 of a ball stitching table. The clamping tool 2 generally includes a clamping head 21 and an elastic clamping unit (not shown) below the clamping head 21. A diameter of the clamping tool 2 is smaller than the half-finished sporting ball 1 so that the half-finished sporting ball 1 can be retained in the clamping head 21. Then by elasticity, the clamping head 21 can expand elastically. Thereby the clamping tool 2 can retained the half-finished sporting ball. Then the 2 pieces of cover panels 11 are stitched.

To stitch the two cover panels over the core requires strong pulling force and lengthy training period for workers. However the hard stitching work and lengthy training period makes it less desirable to attract new workers. Furthermore the work process is slow and the production rate is also low. Thus there is an eager demand for a novel ball stitching machine which requires less hard work for workers, reduces training period time and increases productivity rate.

SUMMARY OF THE INVENTION

Accordingly, the primary object of the present invention is to provide a stitch tightening device of a ball stitching machine, wherein the stitch control device tightly clamps the stitching thread for manufacturing the finished sporting ball so that the worker only needs use minimum force to pull the stitching thread. The operation of this device is convenient for workers and reduces the training time for said workers.

To achieve above object, the present invention provides a stitching thread tightening device of a ball stitching machine comprises a ball stitching table having at least one clamping tool and a stitch tightening unit for tightening the thread of the assembled ball. The stitch tightening unit includes a set of thread clamping units at two sides of the clamping tool. The stitch control device is interconnected with and interacted with a first treadle through a driven element; and the stitch tightening unit has at least two clampers; the first treadle drives a control wire; and then the control wire drives the clamper so as to engage the thread clamping unit. The clamping head is connected to a second treadle through a linkage; the second treadle drives the clamping head to move aside to be away from the stitch control device. The first treadle drives a control wire through a driven element.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
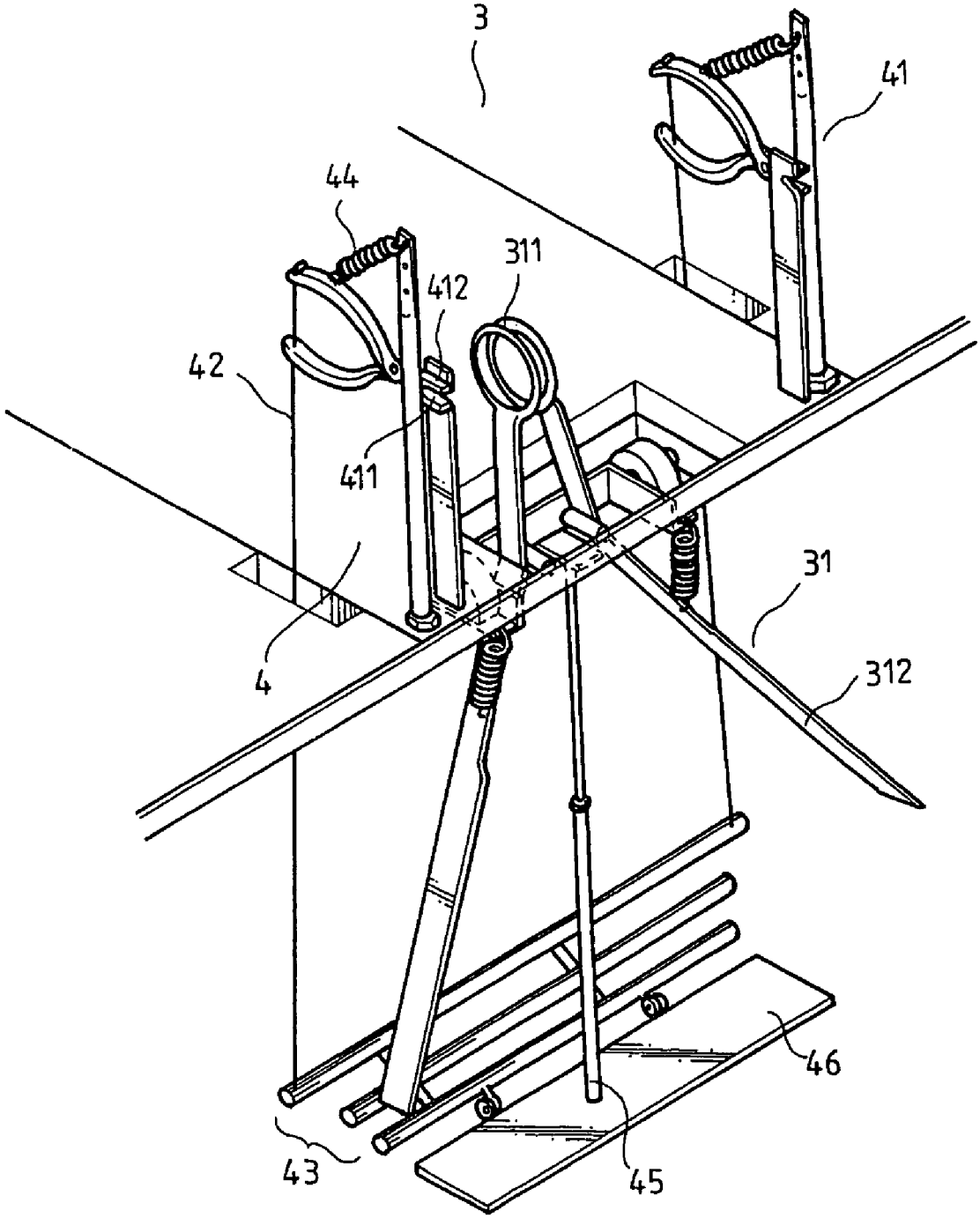
FIG. 1 is a perspective view of the present invention.
Figure 3:
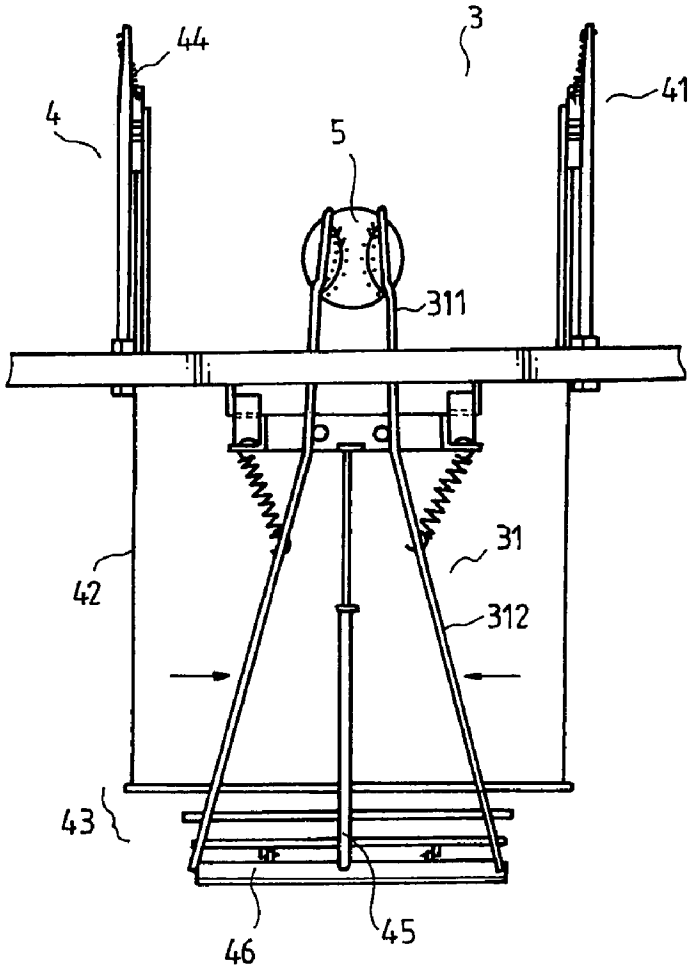
FIG. 3 is a plane view about the clamping of a ball according to the present invention.
Figure 2:
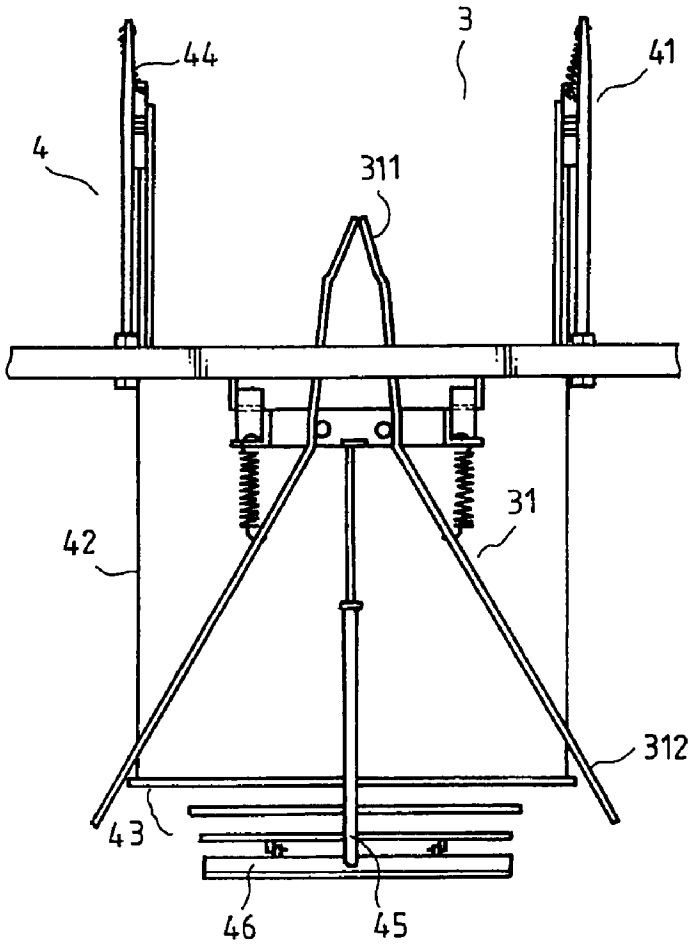
FIG. 2 is a plane schematic view of the present invention.

Referring to FIGS. 1, 2, and 3, the thread retaining device of a ball stitching machine of the present invention is illustrated. The present invention has the following elements.

A ball stitching table 3 includes a clamping tool 31. The clamping tool 31 has a clamping head 311 at an upper portion and an elastic clamping unit 312 at a lower portion thereof. The clamping head 311 has a diameter smaller than that of the half finished sporting ball 5 (referring to FIG. 3) so that the half finished sporting ball 5 can be clamped in the clamping head 311. An elastic clamping unit 312 is used to control the expansion and closing of the clamping head 311.

A stitch control device 4 is installed on the ball stitching table 3 for tightening a thread passing through the half finished sporting ball 5.

The stitch control device 4 has two thread clamping units 41 at two sides of the clamping tool 31. The thread clamping unit 41 serves to clamp a stitching thread 6 temporarily (referring to FIG. 4). Each thread clamping unit 41 has at least two clampers 411, 412. One clamper 411 is connected with and interacted with a control wire 42. Another clamper 412 is fixed. However in the present invention, the two clampers 411, 412 can be movably installed.

Further, the stitch control device 4 is interconnected with and interacted with a first treadle 43 through a driven element 44. The first treadle 43 drives the control wire 42. Then the control wire drives the clamper 411 so as to engage the thread clamping unit 41.

Besides, in the present invention, the clamping head 311 can be connected to a second treadle 46 through a linkage

45. The second treadle 46 can drive the clamping head 311 to move aside to be away from the stitch control device.

Referring to FIG. 3, the ball stitching table 3 of the present invention is illustrated. The half finished sporting ball 5 on the ball stitching table 3 is in a manufacturing state through the clamping head 311.

Figure 4:
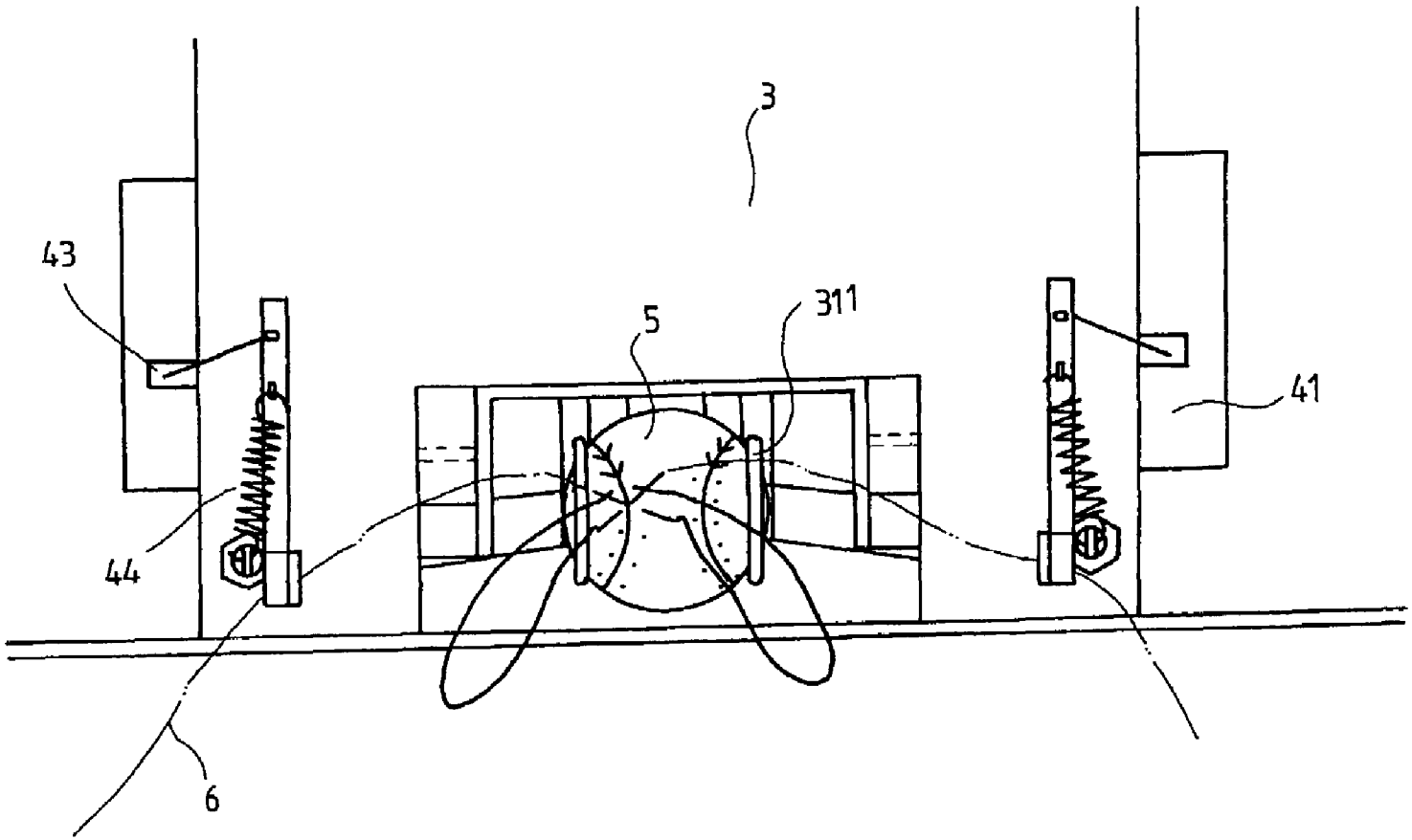
FIG. 4 is a plane schematic view showing the stitching state of the present invention.

Referring to FIG. 4, the half finished sporting ball 5 is stitched by using the stitching thread 6 and the thread clamping units 41 serve to provide the function of clamping the stitching thread 6.

Figure 6:
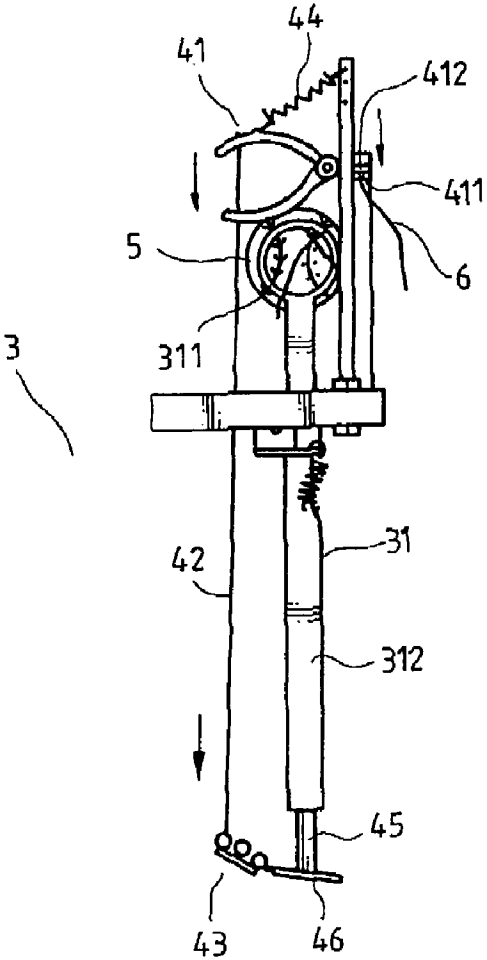
FIG. 6 is a schematic view showing the operation of the first treadle according to the present invention.
Figure 5:
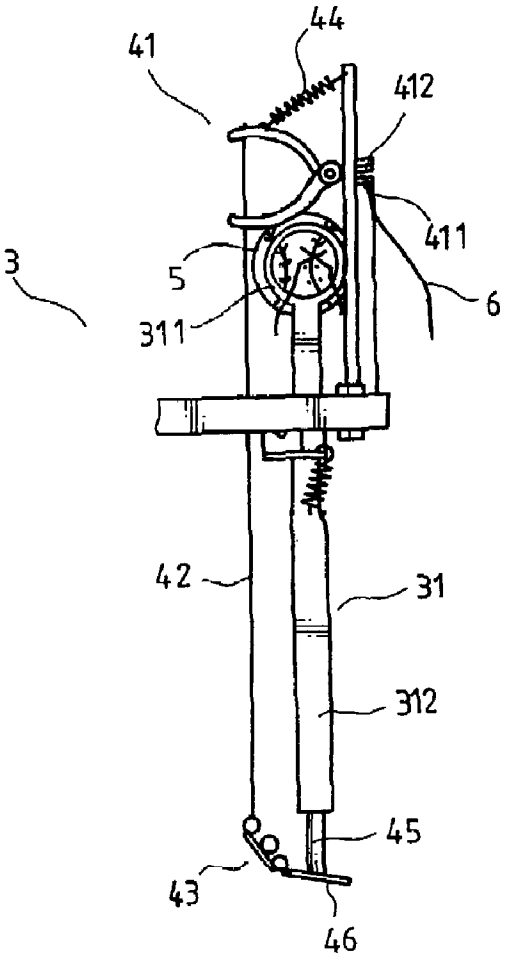
FIG. 5 is a schematic view showing a state that the first treadle does not be operated.
Figure 8:
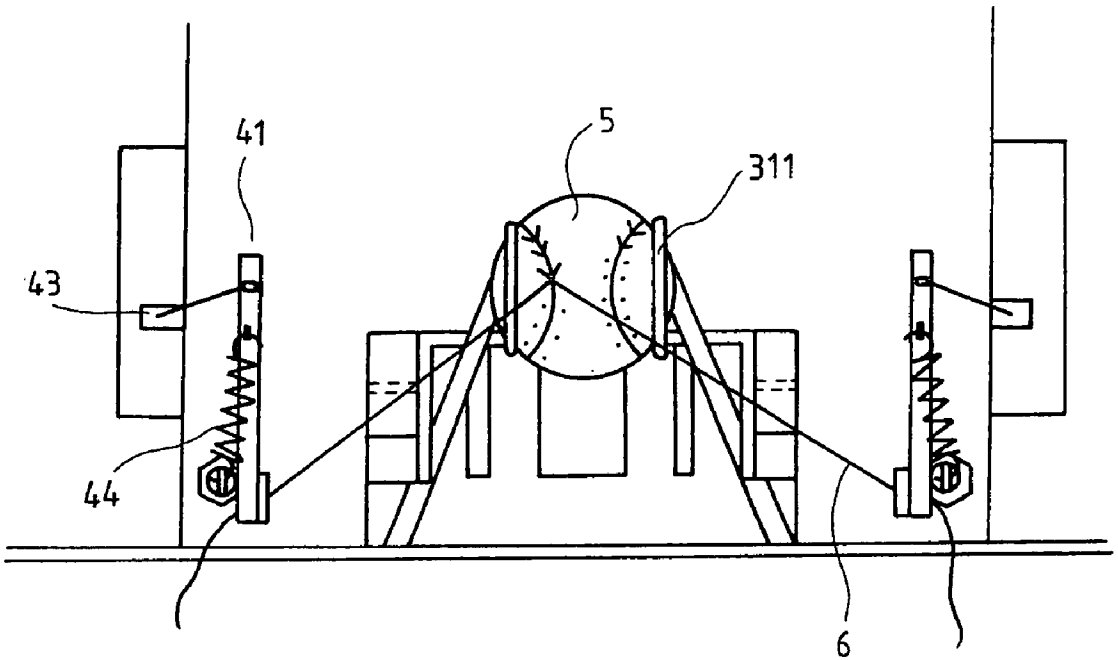
FIG. 8 is a schematic view showing the stitching state of the present invention.
Figure 7:
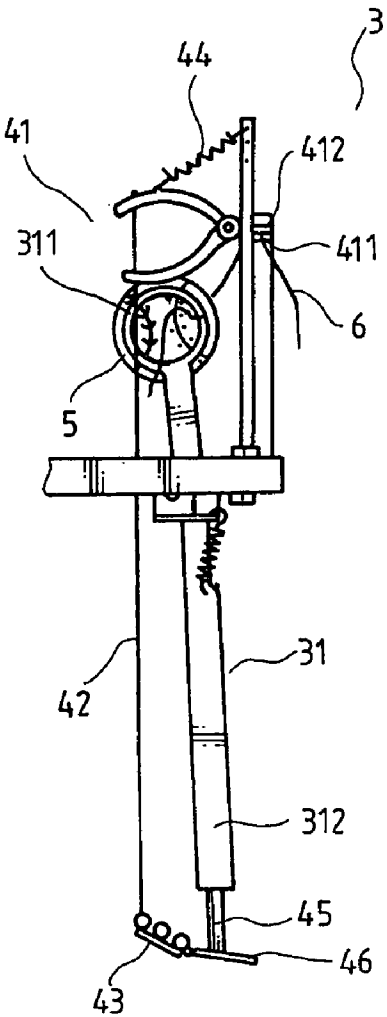
FIG. 7 is a schematic view showing another operation of the first treadle of the present invention.
Figure 9:
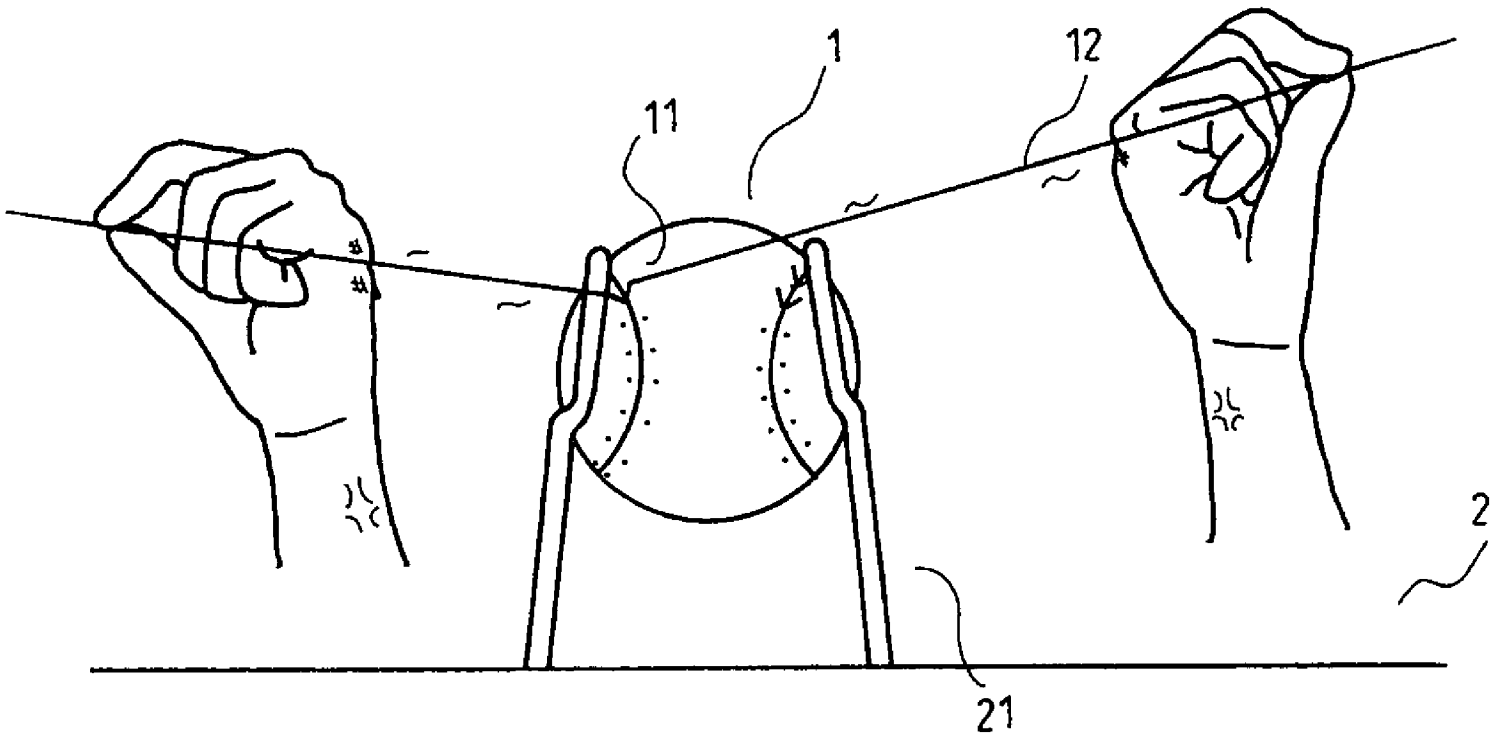
FIG. 9 is a schematic view showing the operation of prior art.

Referring to FIGS. 5 and 6, the operation of the first treadle 43 is illustrated since the first treadle 43 can drive the control wire 42. Then the control wire drives the clamper 411 so as to engage the thread clamping units 41. Moreover in FIG. 7, it is illustrated that when the second treadle 46 moves slightly to shift the clamping tool 31 away from the stitch control device 4. The state is illustrated in FIG. 8.

In the present invention, the stitch control device 4 tightly clamps the stitching thread 6 for manufacturing the half finished sporting ball 5 so that the worker only needs use minimum force to pull the stitching thread 6. The operation of this device is convenient for workers and reduces the training time for said workers.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. A stitch tightening device of a ball stitching machine comprising:

a ball stitching table having at least one clamping tool and a stitch tightening unit for tightening a thread to be assembled to a ball; and wherein a stitch control device is interconnected with and interacted with a first treadle through a driven element; and the stitch tightening unit has at least two clampers; the first treadle drives a control wire; and then the control wire drives the clamper so as to engage the thread clamping unit.

2. The stitch tightening device of a ball stitching machine as claimed in claim 1, wherein a clamping head is connected to a second treadle through a linkage; the second treadle drives the clamping head to move aside to be away from the stitching thread stitch control device.

3. The stitch tightening device of a ball stitching machine as claimed in claim 1, wherein the first treadle drives a control wire through a driven element.

* * * * *